US005978761A

United States Patent [19]

Johansson

[11] Patent Number: 5,978,761

[45] Date of Patent: Nov. 2, 1999

[54] METHOD AND ARRANGEMENT FOR PRODUCING COMFORT NOISE IN A LINEAR PREDICTIVE SPEECH DECODER

[75] Inventor: Ingemar Johansson, Luleå, Sweden

[73] Assignee: Telefonaktiebolaget LM Ericsson, Stockholm, Sweden

[21] Appl. No.: 08/928,523

[22] Filed: Sep. 12, 1997

[30] Foreign Application Priority Data

Sep. 13, 1996 [SE] Sweden ..... 9603332

[51] Int. Cl.[6] ..... G10L 9/14

[52] U.S. Cl. ..... 704/226; 704/233

[58] Field of Search ..... 704/233, 258, 704/219, 222, 225, 221, 226, 227, 228

[56] References Cited

U.S. PATENT DOCUMENTS

| | | | |
|---|---|---|---|
| 5,414,796 | 5/1995 | Jacobs et al. | 704/221 |
| 5,475,712 | 12/1995 | Sasaki | 375/241 |
| 5,537,509 | 7/1996 | Swaminathan et al. | 704/228 |
| 5,657,422 | 8/1997 | Janiszewski et al. | 704/228 |
| 5,689,615 | 11/1997 | Benyassine et al. | 704/219 |
| 5,794,199 | 8/1998 | Rao et al. | 704/258 |
| 5,809,460 | 9/1998 | Hayata et al. | 704/225 |
| 5,835,889 | 11/1998 | Kapanen | 704/215 |
| 5,881,373 | 3/1999 | Elofson et al. | 455/115 |

FOREIGN PATENT DOCUMENTS

| | | | |
|---|---|---|---|
| 0 544 101 | 6/1993 | European Pat. Off. | H04B 1/46 |
| 0768770 | 4/1997 | European Pat. Off. | G10L 5/00 |
| 2256351 | 12/1992 | United Kingdom | H04B 3/20 |
| 2256997 | 12/1992 | United Kingdom | G10L 3/00 |
| WO 95/15550 | 6/1995 | WIPO | G10L 9/00 |
| WO96/32817 | 10/1996 | WIPO | H04Q 1/453 |

OTHER PUBLICATIONS

"European digital cellular telecommunication system; Half rate speech, Part 5: Discontinuous transmission (DTX) for half rate speech traffic channels (GSN 06.41)", ETS 300 581–5, European Telecommunication Standards Institute, Nov. 1995, pp. 14–15.

"European digital cellular telecommunication system (Phase 2); Discontinuous Transmission (DTX) for full rate speech traffic channel (GSN 06.31)", ETS 300 580–5, European Telecommunication Standards Institute, Sep. 1994, pp. 10–14.

Globecom '89, pp. 1070–1074, vol. 2, Nov. 1989, Southcott, C.B. et al., "Voice Control of the Pan–European Digital Mode Radio System", pp.1071–1072.

"European digital cellular telecommunication system; Half Rate Speech, Part. 4: Comfort noise aspects for the half rate speech traffic channels (GSM 06.22)" ETS 300 581–4, European Telecommunication Standards Institute, Nov. 1995, pp. 12–13.

"European digital cellular telecommunication system; Half Rate Speech, Part. 5: Discontinuous transmission (DTX) for half rate speech traffic channels (GSM 06.41)", DRAFT, Version: 0.0.9, European Telecommunication Standards Institute, Jan. 1995.

*Primary Examiner*—Richemond Dorvil

*Attorney, Agent, or Firm*—Burns, Doane, Swecker & Mathis, L.L.P.

[57] ABSTRACT

Comfort noise is produced in a linear predictive speech decoder which operates discontinuously, i.e., treats data frames which alternately represent speech information and background noise. During decoding of received data frames which contain background noise-describing parameters, a first number of these data frames which have been received directly before a speech frame are excluded and replaced with one or more background noise describing frames which have been received earlier. Another number of the background noise-describing frames which have been received immediately after a sequence of speech frames are also left out during the decoding and replaced by one or more background noise-describing frames which have been received before the sequence of speech frames. This results in a minimized degradation of the background noise information and gives an optimal comfort noise on the receiver side.

6 Claims, 4 Drawing Sheets

FIG. 1
PRIOR ART
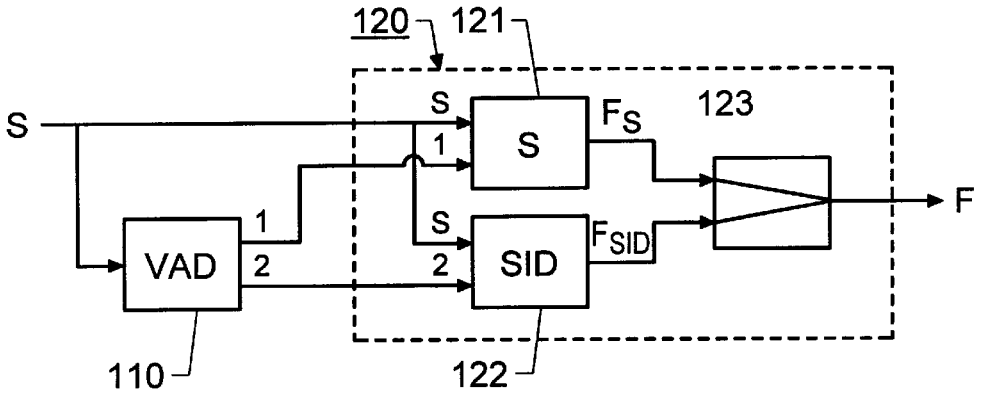
FIG. 2a
PRIOR ART
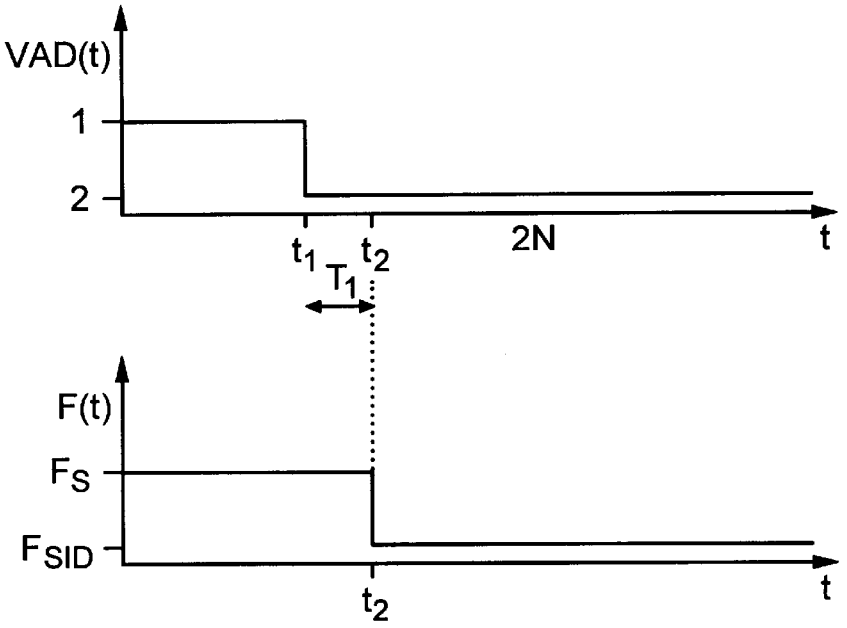
FIG. 2b
PRIOR ART

FIG. 3a
PRIOR ART
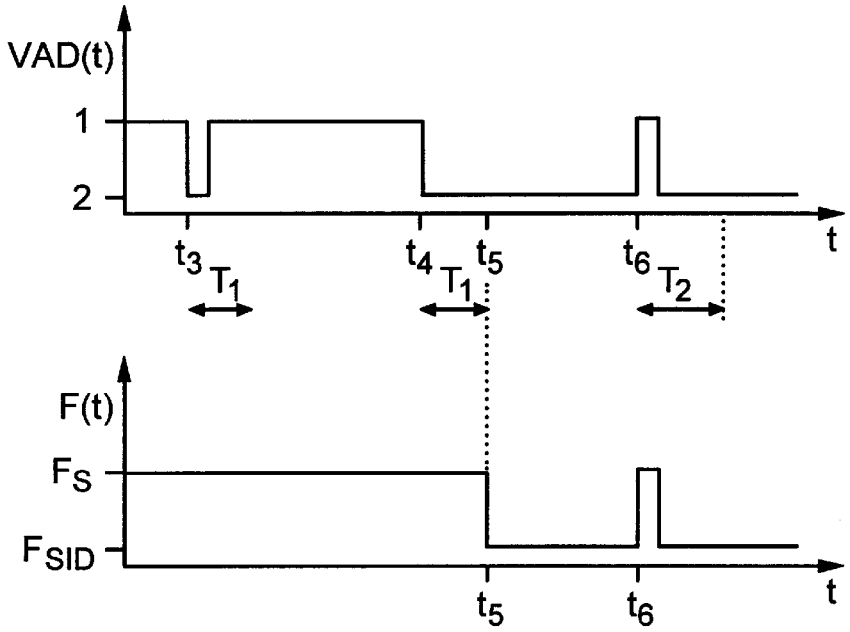
FIG. 3b
PRIOR ART
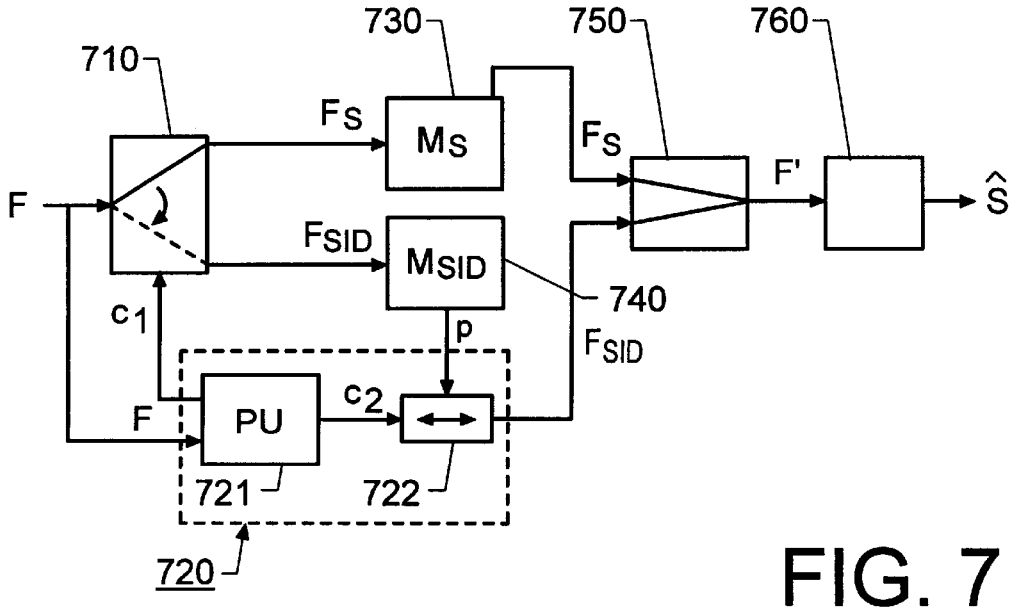
FIG. 7

METHOD AND ARRANGEMENT FOR PRODUCING COMFORT NOISE IN A LINEAR PREDICTIVE SPEECH DECODER

TECHNICAL FIELD

The present invention relates to a method for generating comfort noise in a linear predictive speech decoder which operates discontinuously, i.e. processes data which alternately represent speech information and background noise.

The invention also relates to an arrangement for performing said method.

BACKGROUND

In discontinuous speech coding according to the VOX-principle (VOX=Voice Operated Transmission) a unit which detects voice activity, a so-called VAD-unit (VAD=Voice Activity Detector) decides for each sound sequence received whether the received sound information represents human speech or not. The VAD-unit can have two different conditions. A first condition means that a current sound is classified as human speech and a second condition means that a certain sound is classified as non-speech.

If the VAD-unit detects that a given sound sequence represents speech then the VAD-unit generates a first condition signal and a speech coder unit is controlled to deliver a so-called speech frame which contains coded speech information. If on the other hand a given sound sequence is determined by the VAD-unit to be sound of a type which is not human speech then the VAD-unit generates a second condition signal and an SID-frame generator is controlled to deliver every N'th frame a so-called SID-frame (SID=Silence Descriptor). During the intermediate N−1 possible opportunities to send data neither the SID-frame generator nor the speech frame generator transmit any information and the transmitter is silent.

An SID-frame includes information on estimated background noise levels and estimated noise spectrums on the transmitter side.

The above method is used for example in mobile radio communication systems in order to save battery energy in the mobile terminals in order to administrate the radio bandwidth, i.e. minimize the transmission of radio energy when a given radio channel does not need to be used for the transmission of speech information. This method is, however, also applicable in other types of telecommunication systems when it is required to minimize the bandwidth used per speech connection.

It is known in the prior art in discontinuous speech coding to let a speech coder unit send an SID-frame every N'th frame when the VAD-unit detects non-speech. In known applications, such as for example in the GSM-system (GSM=Global System for Mobile Communication), approximately two SID-frames are sent per second.

The parameters included in the SID-frames: estimated background noise level and estimated noise spectrum are calculated as an average value of a current estimate and the estimates from a number of previous frames. The receiver interpolates furthermore between the received parameter values for N−1 intermediate data positions in order on the receiver side to obtain an evenly varying representation of the background noise on the transmitter side.

When the VAD-unit changes from producing the first to producing the second condition signal, i.e. from detecting speech to detecting non-speech, then normally a time interval of a given length $T_1$, the so-called hangover, is applied in which the speech coder unit continues to deliver speech frames as if the received sound information had been human speech. If the VAD-unit after the hangover time $T_1$ continues to register non-speech then an SID-frame is generated.

The reason for this method is amongst others that short pauses in speech inside sentences shall not be translated as non-speech, but that the speech frame generator in this situation shall continue to be activated. The application of hangover, however, does not solve the problem which noise transients with high energy contents cause. These noise transients risk namely to be interpreted by the VAD-unit as speech and if this occurs then the speech frame generator's parameter will be adapted to the spectral characteristics of the noise transients which will lead to a large degradation of the condition of the speech frame generator. A precondition for the application of hangover is therefore that the previous speech sequences should be longer than a second predetermined time $T_2$.

When the VAD-unit changes from producing the second to producing the first condition signal, i.e. from non-speech to speech then normally no corresponding measure is taken but the speech frame generator is started immediately.

In the European patent application EP-A1-0 544 101 an example is given of how on the receiver side a background noise level can be reconstituted out of received frames which describe the background noise between transmitted speech sequences. The patent document WO-A1-95/15550 describes a method for calculating the average value of the background noise level for a number of historic frames, the current frame and up to two expected future frames out of the so-called noise-only frames. The calculated background noise level is subsequently eliminated out of the received speech signal with the purpose of forming a resulting signal of which the noise content is minimal.

When the VAD-unit changes from producing the first to producing the second condition signal, i.e. from speech to non-speech, there is a risk present that the last received SID-frame or frames parameters have been influenced by the just finished speech sequence. These parameters are namely determined as a average value of the current frame and a number of previous frames. In GSM-standard this problem is solved through a new SID-frame not being sent if the previous speech sequence was so short that the hangover had not been activated, that is to say if the speech sequence had been shorter than the time $T_2$. Instead in this situation a copy of the SID-frame which was sent immediately before said speech sequence is transmitted. See ETSI, TCH-HS, GSM Recommendation 6.41, "Discontinuous Transmission DTX for Half Rate Speech Traffic Channels".

According to the GSM-standard, on the transmitter side the last sent SID-frame is saved when the VAD-unit changes from the second to the first condition, i.e. from non-speech to speech, in order to possibly use the SID-frame as stated above. The parameters in this SID-frame can, however, also be misleading as they can have been influenced by sound from the speech sequence which is beginning. The risk for this is especially large if the condition signal of the VAD-unit changes immediately after an SID-frame has been delivered. If the background noise level is high, then the VAD-unit probably changes the condition signal more frequently than that which is motivated by the speech information on the transmitter side, because certain speech sounds during these conditions can sometimes be misinterpreted as non-speech.

SUMMARY

An object for the present invention is to minimize the degeneration of the parameters of the SID-frames during both changing from the first to the second, and from the second to the first of the condition signals of the VAD-unit.

The present invention presents a solution to the problems which defective SID-frames, i.e. SID-frames of which the parameters in some sense are misleading, cause on the receiver side.

The invention further aims to reduce the effect of high noise transients on the average value of the SID-frames so that these transients are prevented from having an effect on the receiver side.

This is achieved according to the proposed method through one or more of the SID-frames, which describe background noise and which are received directly before a speech frame, not being included in the calculation of the actual background noise. Instead one or more SID-frames which have been received even earlier are included in the calculation of the actual background noise.

According to a preferred embodiment the SID-frame which most closely precedes a speech frame is excluded from the calculation of the actual background noise.

The suggested arrangement is a data receiver the task of which is to reconstruct a speech signal out of received data frames. The data frames can either be speech frames or frames which describe background noise on the transmitter side. The arrangement comprises a control unit for controlling other units comprised in the arrangement, a first memory unit for storing speech frames, a second memory unit for the storage of background noise-describing frames, a data frame controlling unit which guides the received data frames to the respective memory unit and a reconstruction unit which reconstructs a sound signal out of the received data frames. In the control unit is in turn comprised a memory-shifting unit which controls the first and the last memory positions in the second memory unit from which shifting of the data shall take place. The shifted data, i.e. the background noise-describing frames, are fed to the decoding unit together with the received speech frames for reconstruction of the transmitted sound signal. Through stating the memory positions between which the shifting of the data can occur it is possible to consequently choose which part of the transmitted noise information is to be considered during reconstruction of the sound signal.

The suggested method and arrangement offer both simple and effective implementation of decoding algorithms for communication systems which use discontinuous speech transmission. This is a result of that the solution on the one hand is independent of which VAD- or VOX-algorithm the transmitter applies and on the other hand the hangover time, that is to say the time interval in which the speech coder continues to deliver speech frames despite that the VAD-unit register non-speech, can be held relatively short.

BRIEF DESCRIPTION OF THE FIGURES

FIG. 1 shows a prior art arrangement of a VAD-unit and a speech coder unit;

FIGS. 2*a*-2*b* show in diagrammatic form a prior art way of applying hangover during the transmitting of data frames from a speech coder unit which is controlled by a VAD-unit;

FIGS. 3*a*-3*b* illustrate how the hangover time shown in FIGS. 2*a-b* in a prior art method can influence the transmitting of data frames during the transmission of a certain sequence of speech information;

FIG. 7 shows a block diagram of the arrangement according to the invention.

Figure 4:
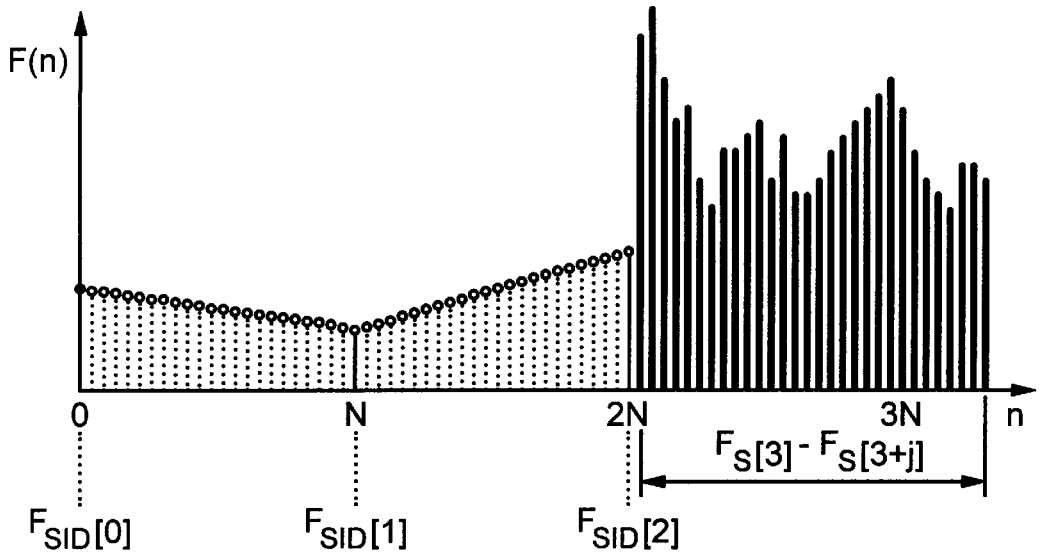
FIG. 4 PRIOR ART
FIG. 4 illustrates in diagrammatic form the data frames which according to a prior art method are transferred when an incoming sound signal comprises a speech sequence which is preceded by a period of non-speech.

The invention will now be described in more detail with the help of preferred embodiments and with reference to the accompanying drawings.

DETAILED DESCRIPTION

FIG. 1 shows a prior art arrangement of a VAD-unit 110 and a speech coder unit 120), where the VAD-unit 110 for each received sequence of sound information S decides whether the sound represents human speech or not. If the VAD-unit 110 detects that a given sound sequence S represents speech then a first condition signal 1 is sent to a speech frame generator 121 in the speech coder unit 120), which in this way is controlled to deliver a speech frame $F_S$ containing coded speech information based on the sound sequence S. If on the other hand the sound sequence S is determined by the VAD-unit 110 to be non-speech then a second condition signal 2 is sent to an SID-generator 122 in the speech coder unit 120), which in this way is controlled to, based on the sound sequence S), every N'th frame deliver an SID-frame $F_{SID}$), which contains parameters which describe the frequency spectrum and the energy level of the sound S. During the intermediate N−1 possible opportunities to transmit data the SID-frame generator, however, does not generate any information. Each generated speech frame $F_S$ and SID-frame $F_{SID}$ passes a combining unit 123), which delivers the frames $F_S$, $F_{SID}$ on a common output in the shape of data frames F.

In FIG. 2*a* is shown a diagram of an output signal VAD(t) from a VAD-unit of which the input signal is a sound signal. Along the vertical axis of the diagram is given the condition signal 1 or 2 which the VAD-unit delivers while the horizontal axis is a time axis t.

FIG. 2*b* shows in diagrammatic form the data frames F(t) which according to a prior art method are generated by a speech coder unit when this is controlled by the VAD-unit above. Along the vertical axis of the diagram is given the type of data frame F(t), i.e. if the actual frame is a speech frame $F_S$ or an SID-frame $F_{SID}$ and along the horizontal axis time t is represented. By way of introduction the VAD-unit detects human speech, wherefore the first condition signal 1 is delivered and the speech coder unit generates speech frames $F_S$. At a first point of time $t_1$), however, the speech signal ceases and the VAD-unit changes to the second condition signal 2. At a second point of time $t_2$ the hangover time $T_1$ has run out and the speech coder unit begins to produce SID-frames $F_{SID}$.

FIGS. 3*a* and 3*b* illustrate in diagrammatic form the same parameters as FIGS. 2*a* and 2*b*, but in this case the input signal to the VAD-unit is first formed by a speech signal which includes a short pause and the end of the sound signal is subjected to a powerful transient background sound. At a first point of time $t_3$ the VAD-unit detects that the sound signal comprises non-speech and therefore delivers the second condition signal 2. Within a shorter time than the hangover time $T_1$ the speech signal, however, continues and the VAD-unit continues to deliver the first condition signal 1. Because the speech pause was shorter than the hangover time $T_1$ the speech coder unit continues to transmit speech frames $F_S$ without sending any SID-frames $F_{SID}$. At another point of time $t_4$ the speech signal ceases wherefore the VAD-unit delivers the second condition signal 2. After the hangover time $T_1$, at a third point of time $t_5$, the VAD-unit continues to register non-speech, which causes the speech coder unit to begin to generate SID-frames $F_{SID}$ instead of speech frames $F_S$. At another somewhat later point of time $t_6$ the sound signal includes a powerful sound impulse the length of which is shorter than a predetermined minimum time $T_2$. The sound pulse is incorrectly interpreted by the VAD-unit as human speech and the first condition signal 1 is therefore delivered. When the sound impulse lastingly is less than the minimum time $T_2$, then no hangover is applied, but the speech coder unit continues to deliver SID-frames as soon as the sound impulse decays.

In FIG. 4 a diagram is shown of the data frames F(n) which according to a prior art method are produced and transmitted when an incoming sound signal consists of an introductory period of non-speech which is followed by a speech sequence. A first background noise describing frame F(0) is sent as a first data frame $F_{SID}[0]$. A second background noise describing frame $F_{SID}[1]$ is sent as a second data frame F(N), N data frame occasions later. During the intermediate N−1 occasions when data frames could have been sent the transmitter is silent and no information is transmitted. Instead the decoder interpolates on the receiver side during this time an N−1 background noise describing parameter. In the diagram this is illustrated as dotted bars. N further data frame occasions later a data frame F(2N) is sent as a third background noise describing frame $F_{SID}[2]$. A speech frame $F_S[3]$ is sent as the next data frame F(2N+1) because at this occasion the VAD-unit has continued to register speech information. The VAD-unit continues to register speech during the following j data frame occasions, wherefore the speech coder unit during this time sends out j speech frames $F_S[3]$–$F_S[3+j]$.

Figure 5:
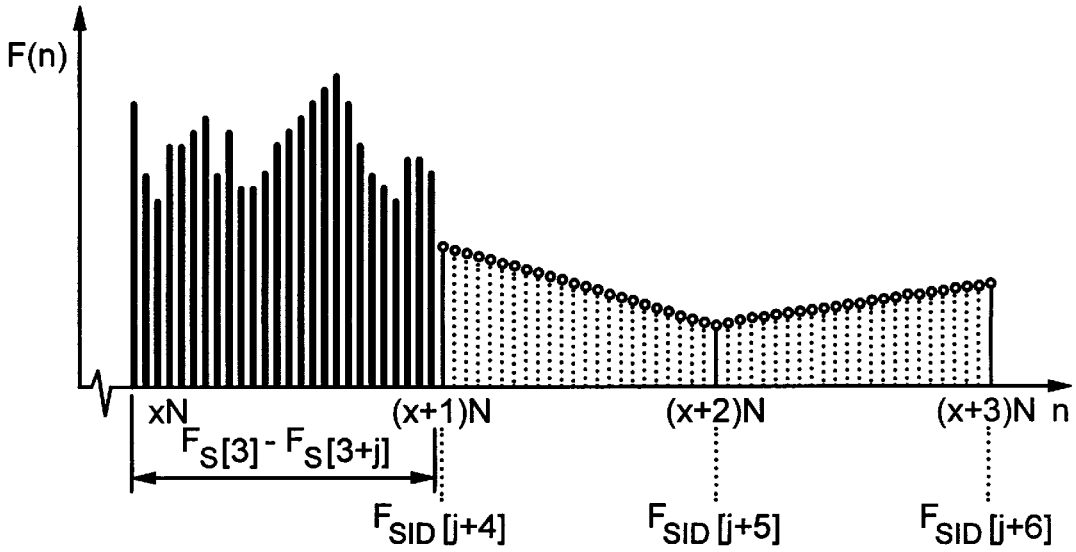
FIG. 5 PRIOR ART
FIG. 5 shows in diagrammatic form the data frames which according to a prior art method are transferred when an incoming speech sequence is followed by a period of non-speech.

In FIG. 5 is shown a diagram of the data frames F(n), which according to a prior art method are produced and transmitted when an incoming sound signal consists of a speech sequence which is followed by non-speech. As long as the VAD-unit detects speech information then the speech coder unit delivers speech frames $F_S[3]$–$F_S[3+j]$. As soon as the VAD-unit has detected non-speech and a possible hangover time has run out, however, the speech coder unit begins to send an SID-frame at every N'th data frame occasion. In this example a first SID-unit $F_{SID}[j+4]$ is sent as a data frame F(x+1)N. N data frame occasions later a second SID-frame $F_{SID}[j+5]$ is sent as a data frame F(x+2)N. During the intermediate N−1 occasions when data frames could have been sent, but where the transmitter is silent, the decoder on the receiver side interpolates an N−1 background noise describing parameter which in the diagram is shown as dotted bars. A further N data frame occasions later a third background noise describing frame $F_{SID}[j+6]$ is sent as a data frame F(x+3)N.

Figure 6A:
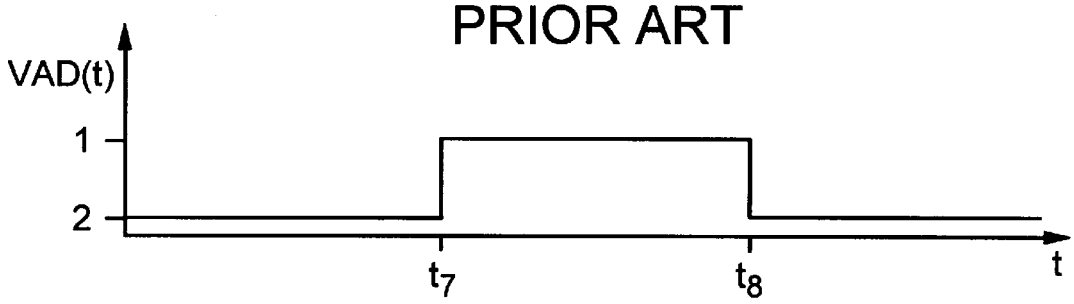
FIG. 6a PRIOR ART
FIG. 6*a* shows an example of how a VAD-unit in a prior art method switches between a first and a second condition signal in accordance with the variations in a sound signal.

FIG. 6*a* illustrates in a diagram how a VAD-unit's condition signals VAD(t) in a prior art way switch when the sound input signal to the VAD-unit consists of non-speech, speech and non-speech in that order. The vertical axis of the diagram gives the condition signal 1, 2 and the horizontal axis forms a time axis t.

Figure 6B:
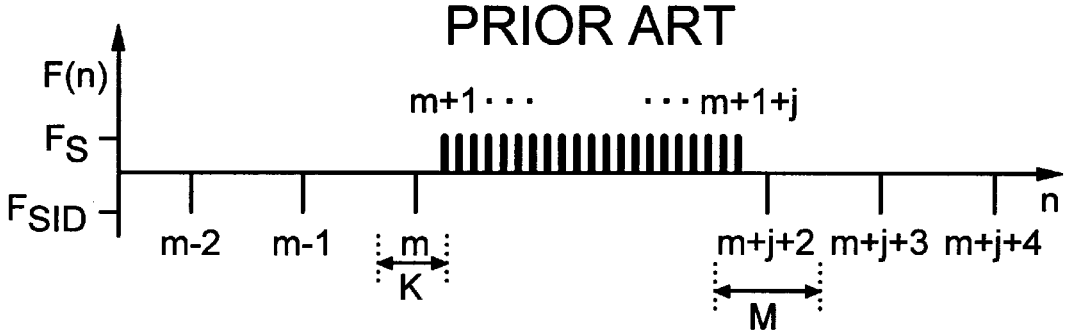
FIG. 6b PRIOR ART
FIG. 6*b* illustrates the data frames which a speech coder unit delivers when it receives the sound information according to the example which is shown in FIG. 6*a;*

FIG. 6*b* illustrates schematically the type of data frames F(n) which are delivered from a previously known speech coder unit which gives the same input signal as the VAD-unit represented in FIG. 6*a*. The type of data frame $F_S$, $F_{SID}$ is represented along the vertical axis and along the horizontal axis is given the order number n of the data frames.

Figure 6C:
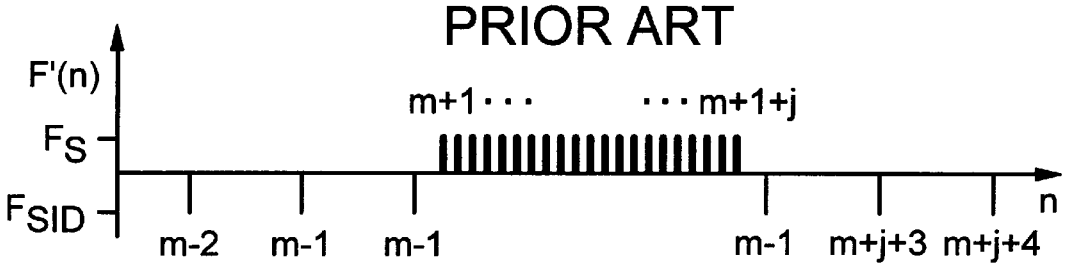
FIG. 6c PRIOR ART
FIG. 6*c* illustrates which of the data frames in FIG. 6*b* which the decoding unit on the receiver side according to the suggested method uses during the reconstruction of the sound signal, as referred to in FIG. 6*a;*

FIG. 6*c* illustrates which data frames F'(n) which according to the suggested method are taken into account by the receiver during the construction of the sound signal which is decoded by the speech coder unit referred in FIG. 6*b*. The type of speech frame $F_S$, $F_{SID}$ is represented along the vertical axis and along the horizontal axis is given the order number n of the data frames.

By way of introduction the VAD-unit detects non-speech wherefore the speech coder unit is controlled to generate an SID-frame $F_{SID}[m-2]$, $F_{SID}[m-1]$, $F_{SID}[m]$ at every Nth data frame occasion. In the case that the VAD-unit at a first time point $t_7$ detects speech information it changes the condition signal from the second 2 to the first 1 condition. At the same time the speech coder unit begins to deliver speech frames $F_S[m+1], \ldots, F_S[m+1+j]$), as an output signal F(n) instead of SID-frames $F_{SID}$. At another point of time $t_8$ the VAD-unit again detects non-speech which results in that the speech coder unit after a possible hangover time generates an SID-frame $F_{SID}[m+j+2]$, $F_{SID}[m+j+3]$, $F_{SID}[m+j+4]$ at every N'th data frame occasion.

When the decoder unit on the receiver side decodes the received data frames a first predetermined number K of the SID-frames $F_{SID}[m]$ which were transmitted directly before the sequence of speech frames $F_S[m+1], \ldots, F_S[m+1+j]$), are not used. The parameters in these SID-frames $F_{SID}[m]$ can namely have been influenced by sound from the beginning speech sequence and therefore give a misleading description of the actual background noise. In this example it is assumed that K is one, which thus means that only the SID-frame $F_{SID}[m]$ which is sent directly before the first speech frame $F_S[m+1]$ is not taken into account during the reconstruction of the sound signal. Instead of taking into account the parameters in this SID-frame $F_{SID}[m]$), the corresponding parameters from at least one of the directly preceding SID-frames $F_{SID}[m-1]$ are used. In FIG. 6*c* this is illustrated through the m th data frame of F' being replaced with a copy of F'(m−1).

During decoding of the received data frames a predetermined other number M of the SID-frames $F_{SID}[m+j+2]$, $F_{SID}[m+j+3], \ldots$ ), which are sent immediately after the sequence of speech frames $F_S[m+1], \ldots, F_S[m+1+j]$ are not used either, because the parameters in these SID-frames $F_{SID}[m+j+2]$, $F_{SID}[m+j+3], \ldots$ can also have been disturbed by the recently closed speech sequence. In the illustrated example M is assumed to be one which thus means that only the SID-frame $F_{SID}[m+j+2]$ which is sent directly after the last speech frame $F_{S[m+}1+j]$ is not taken into account during the reconstruction of the sound signal. Instead of considering the parameters in this SID-frame $F_{SID}[m+j+2]$ the corresponding parameters out of at least one of the SID-frames $F_{SID}[m-1]$), which are sent before the sequence of speech frames $F_S[m+1], \ldots, F_S[m+1+j]$), are used. The last sent SID-frame which can be taken into account may at the most have an order number which is K+1 less than the first speech frame $F_S[m+1]$), that is to say m+1−K+1=m−K. As K in this example is assumed to be one, then $F_{SID}[m-1]$ is the last sent SID-frame which can be used here. In FIG. 6*c* this is illustrated through the data frame with the order number m+j+2 of F' being replaced also with a copy of F'(m−1).

A block diagram of an apparatus for performing the method according to the invention is shown in FIG. 7. Incoming data frames F are delivered partly to a data frame controlling unit 710 and partly to a control unit 720. A central unit 721 in the control unit 720 detects for each received frame F if the actual data frame F is a speech frame F or a background noise describing frame $F_{SID}$. A first control signal $c_1$ from the central unit 721 controls the data frame directing unit 710 to deliver an incoming data frame F to a first memory unit 730 if the data frame F is a speech frame $F_S$ and to a second memory unit 740 if the data frame F is a background noise describing frame $F_{SID}$. With an incoming speech frame $F_S$ the control signal $c_1$ is set to a first value, for example one and with an incoming background noise describing frame $F_{SID}$ the control signal $c_1$ is set to another value, for example zero. The central unit 721 also generates a second control signal $c_2$), which controls a memory shifting unit 722 to give the memory positions p in the second memory unit 740 from which the data is read out of the memory unit 740. A decoding unit 760 is used on the receiver side in order to reconstruct the sound signal S produced on the transmitter side, which with the help of the data frames F has been transmitted to the receiver side. Data frames F describing human speech $F_S$ are taken to the decoding unit 760 from the first memory unit 730 for reconstruction of the transmitted speech information. During the reconstruction of the background noise on the transmitter side the data frames F are taken from the second memory unit 740 which contains background noise describing frames $F_{SID}$. The speech frames $F_S$ are read in the same order as they have been stored in the memory unit 730), that is to say first in first out, while the reading of the background noise describing frames $F_{SID}$ is controlled with the help of the second control signal $c_2$ according to the method which has been described in connection to the FIGS. 6*a–c* above. The data frames F' which are the basis for a reconstructed sound signal S and which form the input signal to the decoding unit 760 consequently differ somewhat from the data frames F which are received, as K background describing frames $F_{SID}$ before the sequence of speech frames $F_S$ and M background noise describing frames $F_{SID}$ after the sequence of speech frames $F_S$ have been excluded and replaced with copies of earlier received background noise-describing frames $F_{SID}$.

What is claimed is:

1. Method in a telecommunication system in which speech information is transmitted from a transmitter side to a receiver side, whereby speech information for a given speech connection is transmitted discontinuously in the form of data frames, which can be speech frames and background noise describing frames, in order to form a background noise on the receiver side from the received background noise describing frames, the method comprising:

calculating parameters which describe the background noise on the transmitter side through interpolation between the information content in two or more of the received background noise describing frames, excluding K of the background noise describing frames, which directly precede a speech frame, during said calculation of the parameters which describe the background noise for a given data frame, and using one or more earlier received background noise describing frames in order to calculate the background noise for said data frame.

2. Method of claim 1, wherein K=1.

3. Method of claim 1, further comprising:

excluding M of the background noise describing frames, which follow directly after a received sequence of speech frames, during said calculation of parameters which describe the background noise, and using M background noise describing frames of the background noise describing frames which have been received before said sequence of speech frames in order to calculate the background noise.

4. Method according to claim 3, wherein M=1.

5. Method according to claim 1, wherein said parameters indicate the power level and spectral distribution of the background noise.

6. Apparatus for generating a reconstructed speech signal out of received data frames which can be formed from speech frames and background noise describing frames, comprising:

a control unit, a first memory unit for storage of speech frames, a second memory unit for storage of background noise describing frames, a data frame directing unit which guides a received data frame to the first memory unit if the actual data frame is a speech frame and to the second memory unit if the actual data frame is a background noise describing frame, and a decoding unit in which data frames are decoded and form the reconstructed speech signal, wherein the control unit comprises a memory shift unit in order to control the memory positions in the second memory unit from which the reading of the background noise describing frames to the decoding unit takes place.

* * * * *